US005622331A

United States Patent [19]

Kosaka et al.

[11] Patent Number: 5,622,331

[45] Date of Patent: Apr. 22, 1997

[54] METHOD AND APPARATUS FOR WINDING A WIRE ON A WORK PIECE

[75] Inventors: Takao Kosaka, Saitama; Satoshi Tomihara, Kanagawa; Hisahiro Tanaka, Chiba, all of Japan

[73] Assignee: Sony Corporation, Japan

[21] Appl. No.: 449,553

[22] Filed: May 24, 1995

[30] Foreign Application Priority Data

Jun. 6, 1994 [JP] Japan ..... 6-145823

[51] Int. Cl.[6] ..... H01F 41/08

[52] U.S. Cl. ..... 242/437.3; 242/440.1

[58] Field of Search ..... 242/437.2, 437.3, 242/437, 440.1; 29/605

[56] References Cited

U.S. PATENT DOCUMENTS

| | | | |
|---|---|---|---|
| 4,023,740 | 5/1977 | Broomfield | 242/7.17 |
| 4,093,132 | 6/1978 | Christiana et al. | 242/7.03 |
| 4,547,238 | 10/1985 | Lenders | 242/7.03 |
| 4,669,675 | 6/1987 | Parenteau | 242/7.09 |
| 4,901,930 | 2/1990 | Takahashi et al. | 242/7.14 |
| 4,946,112 | 8/1990 | Nelle et al. | 242/7.14 |
| 5,484,113 | 1/1996 | Watanabe | 242/7.03 |

FOREIGN PATENT DOCUMENTS

| | | |
|---|---|---|
| 0582409 | 2/1994 | European Pat. Off. . |
| 0596628 | 5/1994 | European Pat. Off. . |

*Primary Examiner*—Katherine Matecki
*Attorney, Agent, or Firm*—Ronald P. Kananen

[57] ABSTRACT

An apparatus for winding a wire onto a one-piece deflection yoke frame is such that the wire is fed from a winding supply source to a nozzle unit. A guide mechanism for holding the wire from the nozzle unit draws the wire to a work piece which is disposed on a work receiving base. The wire is then clamped by a wire clamp and wound onto the work piece by a predetermined sequence of movements of the nozzle unit, the guide mechanism and rotation of the work receiving base.

20 Claims, 13 Drawing Sheets

METHOD AND APPARATUS FOR WINDING A WIRE ON A WORK PIECE

BACKGROUND OF THE INVENTION

1. Field of the Invention

The present invention relates to a winding apparatus for winding a wire around a deflection yoke frame to obtain a saddle type coil or the like. The present invention also relates to a work winding method therefor.

2. Description of the Related Art

A conventional deflection yoke frame of a deflection yoke used in a conventional television receiver has two deflection frame halves. A vertical coil is wound around one of the deflection frame halves and a horizontal coil is wound around the other. The two halves are assembled to form a deflection coil on a single funnel-like deflection yoke frame. Accordingly, it is relatively easy, because of the two-part construction, to wind a saddle type coil or the like on the deflection yoke frame.

However, today, the so called "high vision" type television receiver has come into wide spread use. In this type of television the deflection yoke frame is formed as a one-piece funnel-like shaped unit. For this reason, it suffers from the drawback that winding of the coil is difficult. Various winding devices and winding methods have been proposed to overcome this difficulty.

FIG. 1 is a perspective view showing one example of a deflection yoke frame of the conventional high vision type of television receiver.

A deflection yoke frame 21 shown in FIG. 1 has a generally funnel-like shape that gradually increases in diameter toward one end. A large opening portion 21*a* is disposed near a fluorescent display surface side of a cathode ray tube, while the small opening portion 21*b* is disposed on the narrow neck side of the cathode ray tube.

A plurality of retaining pieces 21*c*, a plurality of winding grooves 21*d* and a single opening-portion circumferential groove 21*e* are provided on the side of the opening portion 21*a* of the deflection yoke frame 21, whereas a plurality of retaining pieces 21*f*, winding grooves 21*g* and opening-portion circumferential groove 21*e* are provided on the side of the opening portion 21*b* of the deflection yoke frame 21. A wire is wound on an inner circumferential surface of the deflection yoke frame 21 to form a saddle type coil.

FIGS. 2 and 3 show an example of the winding steps used in forming a saddle type coil 9*a* by winding a wire 9 around the deflection yoke frame 21. An explanation will be made as to the winding operation with reference to FIGS. 2 and 3 wherein reference numeral 4 denotes a nozzle unit on the winding device side, and reference numeral 5 denotes a guide unit on the winding device side.

A free end of the wire 9 is first gripped by a nozzle 18 of the nozzle unit 4. The nozzle unit 4 is lowered down to the opening portion 21*b* through a center of the deflection yoke frame 21, the free end of the wire 9 is clamped in this position by retaining unit (not shown), and the free end is retained by a retaining portion 21*k* provided at a predetermined position of the opening portion 21*b*.

Subsequently, the guide unit 5 is used to pick up the wire 9 and withdraw it so that the wire 9 does not become hooked on the retaining piece 21*f* when the yoke 21 is rotated. The wire 9 is then caused to extend through the groove 21*g* from one retaining piece 21*f* to a predetermined retaining piece

21*f* and is raised through the center of the deflection yoke frame 21 from the retaining piece 21*f*. The wire 9 is thereafter caused to extend from the retaining piece 21*c* provided at a predetermined position on the side of the opening portion 21*a* of the deflection yoke frame 21 to a predetermined retaining piece 21*c*' through the opening-portion circumferential groove 21*e*. The wire 9 is then lowered through the center of the deflection yoke frame 21 from the retaining piece 21*c*' and returned back to the retaining piece 21*f* in order. This process is repeated to obtain a predetermined number of windings. Finally, the retaining unit clamps the free end of the wire 9 to a predetermined retaining portion 21*k* and then cuts it to form a single saddle type coil 9*a*. Thus, a plurality of saddle type coils are provided on the inner surface of the deflection yoke frame 21 to form a deflection coil assembly. Details of the above-described winding method are disclosed in pending U.S. Pat. No. 5,484,113 issued on Jan. 16, 1996 in the name of Watanabe. The content of this patent is hereby incorporated by reference thereto.

In the structure shown in FIGS. 2 and 3, the retaining portions 21*k* are formed in the deflection yoke frame 21 in advance. However, in some cases, these retaining portions 21*k* are not formed. In such cases the retaining pieces 21*c* are used to perform both functions. In those cases where the wire is clamped to the retaining pieces 21*c*, the opening-portion circumferential groove 21*e* is too narrow to allow the formation of a large number of windings.

As described above, in the conventional winding apparatus in the event that the entangling or retaining portions are not provided at predetermined positions of the deflection yoke frame 21, a method of retaining/clamping the wire 9 at the retaining pieces 21*c* is used. However, the convention winding apparatus suffers from the drawback that it is impossible to set a predetermined length of the wire 9 because it is necessary to avoid the reduction of an effective width of the opening-portion circumferential groove 21*e*. In other words, the conventional apparatus suffers from the problem that the length of wire 9 which can be retained corresponds to only two or three turns, and it is impossible to withdraw a length of the wire 9 sufficient to fix the free end of the wire 9 to a fixed pin (not shown) located at a predetermined position.

SUMMARY OF THE INVENTION

In view of the above-noted defects, an object of the invention is to provide a wire winding method and apparatus for winding an adequate length of wire to a deflection yoke frame having no retaining portions.

In order to attain this and other objects, there is provided a winding apparatus for winding a wire fed from a winding feeding source to a work piece, comprising: a nozzle unit to which the wire is fed, and which is driven to move up and down; a guide mechanism for holding the wire introduced from the nozzle unit and for guiding the wire to the work piece; a work receiving base on which the work piece is disposed; a wire clamp for clamping the wire after it has been guided to the work piece by the guide mechanism; and means for rotating the work receiving base. With this arrangement, after the wire has been clamped by the wire clamp, the wire is wound on the work piece by the a movement of the nozzle unit, a holding operation of the guide mechanism and a rotational operation of the rotary portion.

According to another aspect of the invention, there is provided a winding method for winding a wire fed from a winding feeding source to a work piece in an winding apparatus, the apparatus comprising: a vertically movable nozzle unit to which the wire is fed; a guide mechanism for holding the wire introduced from the nozzle unit and for guiding the wire to the work piece; a work receiving base on which the work piece is laid; a wire clamp for clamping the wire that has been guided by the guide mechanism; and rotary means for rotating the work receiving base, the winding method comprising the following steps of: clamping the wire using the wire clamp; and after the clamping, winding the wire onto the work piece via a predetermined combination of a) a movement of the nozzle unit, b) a holding operation of the guide mechanism and c) a rotational operation of the rotary means.

With such an arrangement, even if the retaining pins are not provided on the work piece, because the wire clamping mechanism is provided on the work receiving base, the wire is clamped by the engagement operation between the nozzle unit and the wire clamping mechanism, and further the coil winding operation of the wire to the work piece is carried out by the nozzle unit, the work receiving base and the wire guide mechanism in cooperation. Accordingly, even if the retaining pins are not provided in the work piece, it is possible to wind the wire as desired. The winding precision is enhanced and a winding time may be shortened to enhance the productability or the like.

When the wire is clamped by the above-described clamping mechanism and the wire is wound at the entangling or retaining portion provided at a predetermined position on the work piece, if the guide rollers are provided for guiding the wire along the outer portion of the work piece, when the coil winding operation of the wire is effected, the wire is tensioned by the guide rollers provided on the outer peripheral portion of the work receiving base, and the tension is applied to the wire up to the work winding operational position. Accordingly, it is possible to set a sufficient length of the wire and to have the wire reach the desired end portion.

Furthermore, it is possible to dispense with the operation of retaining the wire on the work piece.

In addition, since the winding on a work piece having the retaining portions is carried out by an interaction of the nozzle unit, the work receiving base and the wire guide mechanism, it is additionally possible to perform the winding operation and retaining operation of the wire for work pieces which are provided with the retaining portions.

DESCRIPTION OF THE PREFERRED EMBODIMENTS

An embodiment of the present invention will now be described in detail with reference to the accompanying drawings.

Figure 4:
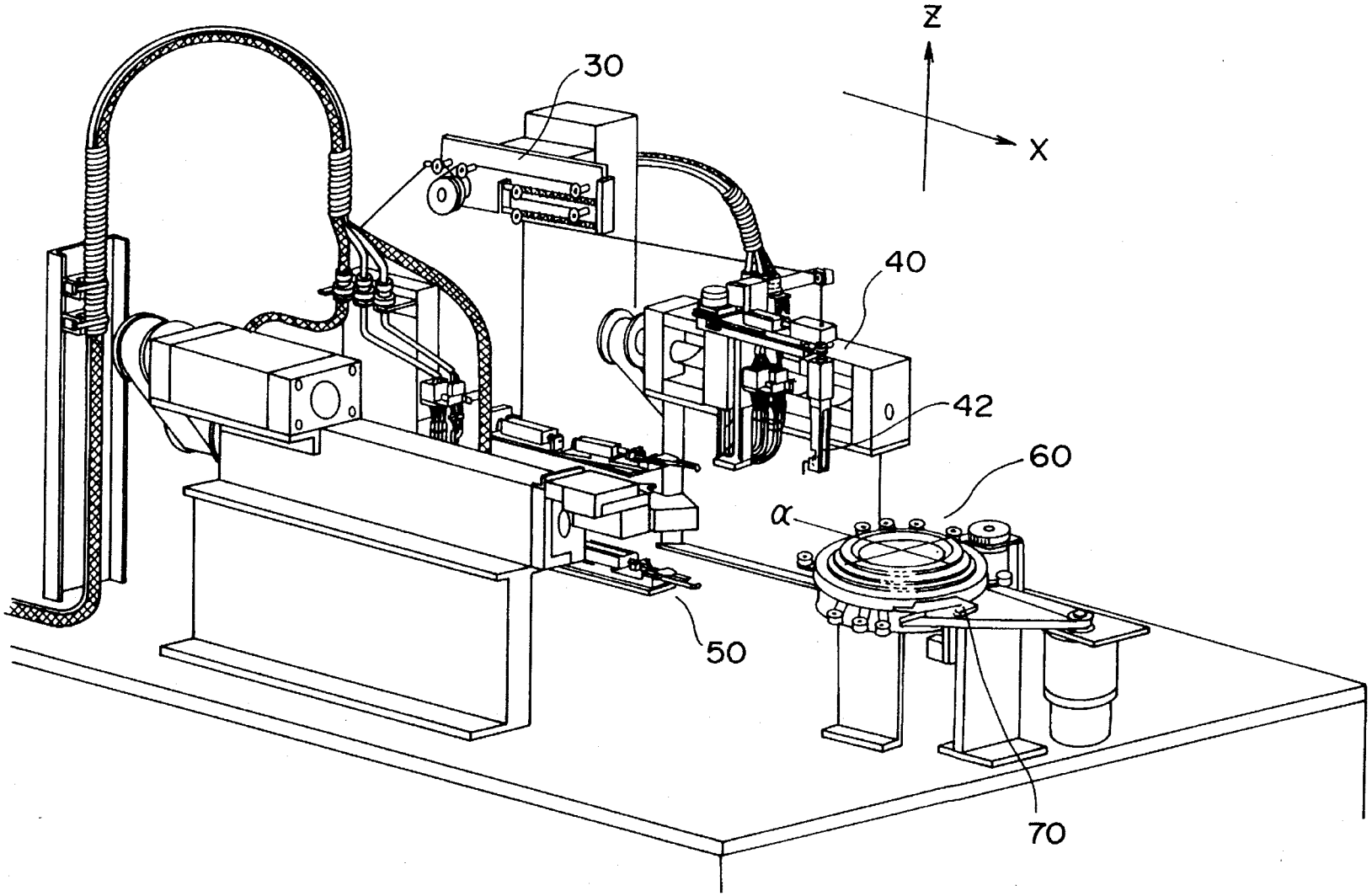
FIG. 4 is a perspective showing an overall structure of a winding apparatus according to the present invention.

FIG. 4 is a perspective view showing an overall structure of a winding apparatus according to the present invention. In FIG. 4, the winding apparatus generally includes a winding feeding section 30, a nozzle unit 40, a guide unit 50, a work receiving base 60, a clamping mechanism 70 and the like. Incidentally, the following explanation will be made as to the case where the winding apparatus is used to form a saddle type coil, i.e., a work piece shown in FIG. 1, by winding the wire 9 around the deflection yoke frame 21. It should be noted that a nozzle 42 of the nozzle unit 40, a guide hook 51 of the guide unit 50 and a centerline $\alpha$ of the work receiving base 60 are included in a single XZ plane.

Figure 5:
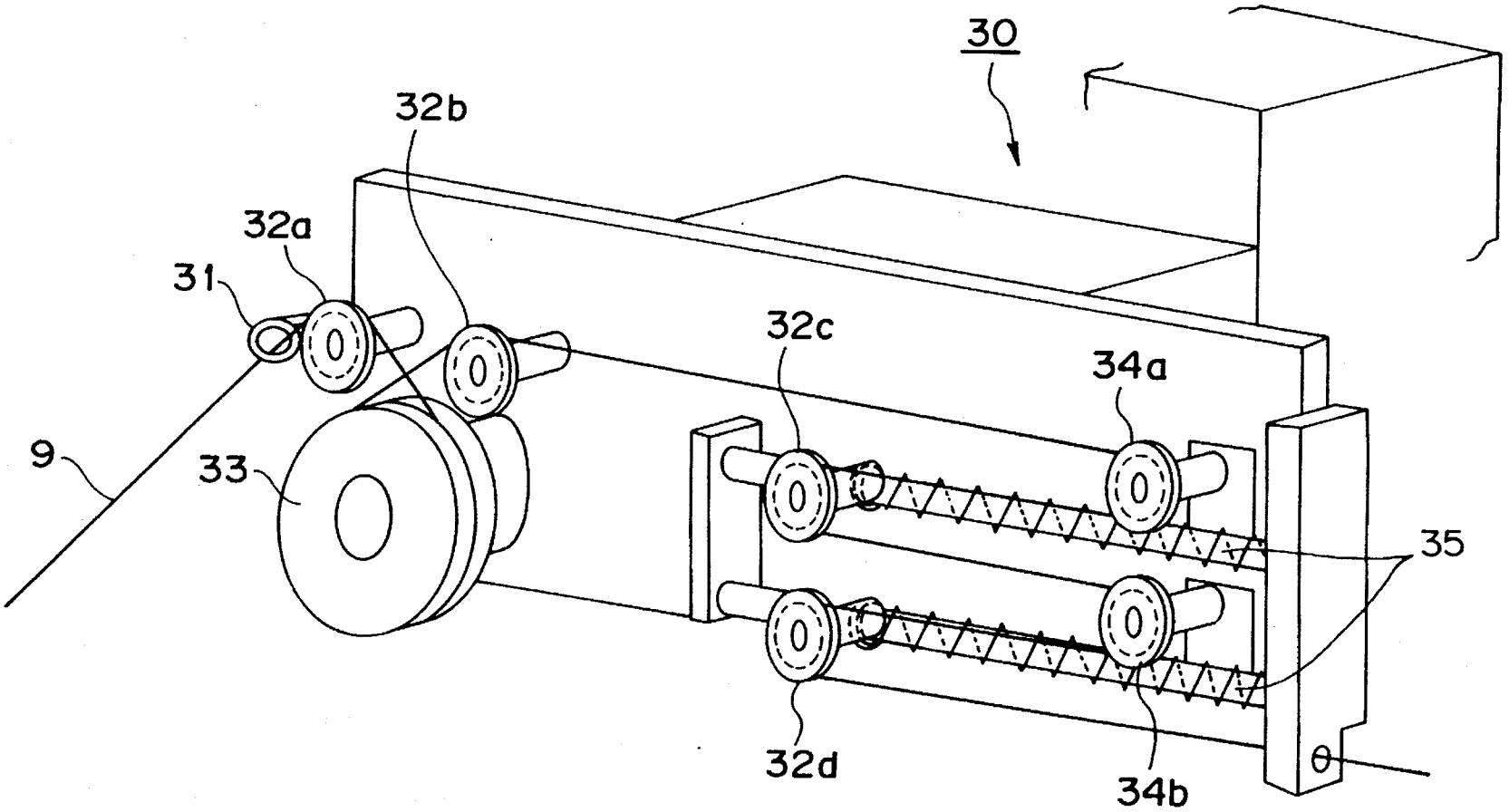
FIG. 5 is a perspective view showing a primary part of a winding supply portion of the winding apparatus shown in FIG. 3.

FIG. 5 is a perspective view showing a primary part structure of the winding feeding section 30. A snail guide 31, guide pulleys 32*a*, 32*b*, 32*c* and 32*d*, a pulley 33, tension pulleys 34*a* and 34*b* and the like are provided in the winding feeding portion.

A wire 9 fed from a winding supply source (not shown) is caused to pass through the snail guide 31 and is introduced into the guide pulley 32*a* and further introduced from the guide pulley 32*a* to a pulley 33 of a hysteresis brake. The wire is wound by one turn around the pulley 33 and thereafter is fed to the nozzle unit 40 through the guide pulley 32*b*, the tension pulley 34*a*, the guide pulley 32*c*, the tension pulley 34*b* and the guide pulley 32*d*.

Coil springs 35 are mounted on the tension pulleys 34*a* and 34*b*. The coil springs 35 normally urge the tension pulleys 34*a* and 34*b* in a direction that the tension pulleys 34*a* and 34*b* are moved in a direction away from the guide pulleys 32*c* and 32*d*, respectively, to thereby impart tensions to the wire 9 that passes through the winding feeding section 30.

Figure 6:
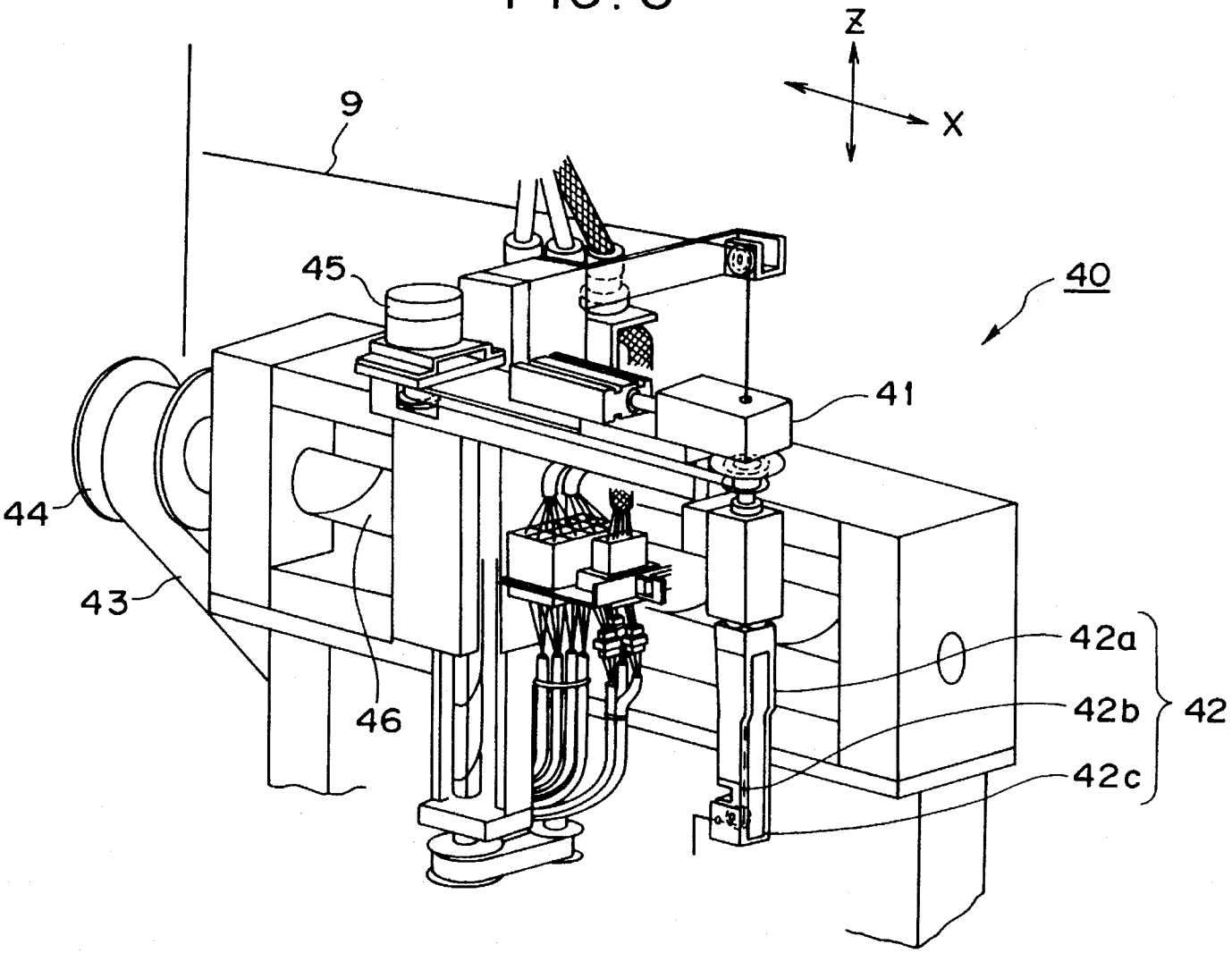
FIG. 6 is a perspective view showing a primary part of nozzle unit of the winding apparatus shown in FIG. 3.

FIG. 6 is a perspective view showing a primary part structure of the nozzle unit 40. The nozzle unit is composed of a stop housing 41, a nozzle 42, a belt 43, a pulley 44 and the like. A tip portion of the nozzle 42 is composed of a nozzle body 42*a*, a head socket 42*b* and a nozzle head 42*c*. These three components can be separated from each other.

The wire 9 that has passed through the winding supply section 30 is introduced (for example, manually) through the stop housing 41 and the nozzle 42 to the guide unit 50 and is engaged by the guide hook thereof in readiness for winding onto the work piece.

The reciprocal movement of the nozzle 42 along the X axis (back-and-forth or longitudinal direction) during the winding operation is attained by a rotation of a unit drive screw 46 through the belt 43 and the pulley 44 by a drive of a servo motor (not shown). Namely, the back-and-forth operation of the nozzle 42 is carried out by the feeding operation of the unit drive screw 46. Also, the movement of the nozzle 42 along the Z axis (i.e., up-and-down or vertical direction) is carried out by another servo motor (not shown). Also, a rotation of the nozzle during the winding operation is carried out by a drive of a stepping motor 45.

Figure 7:
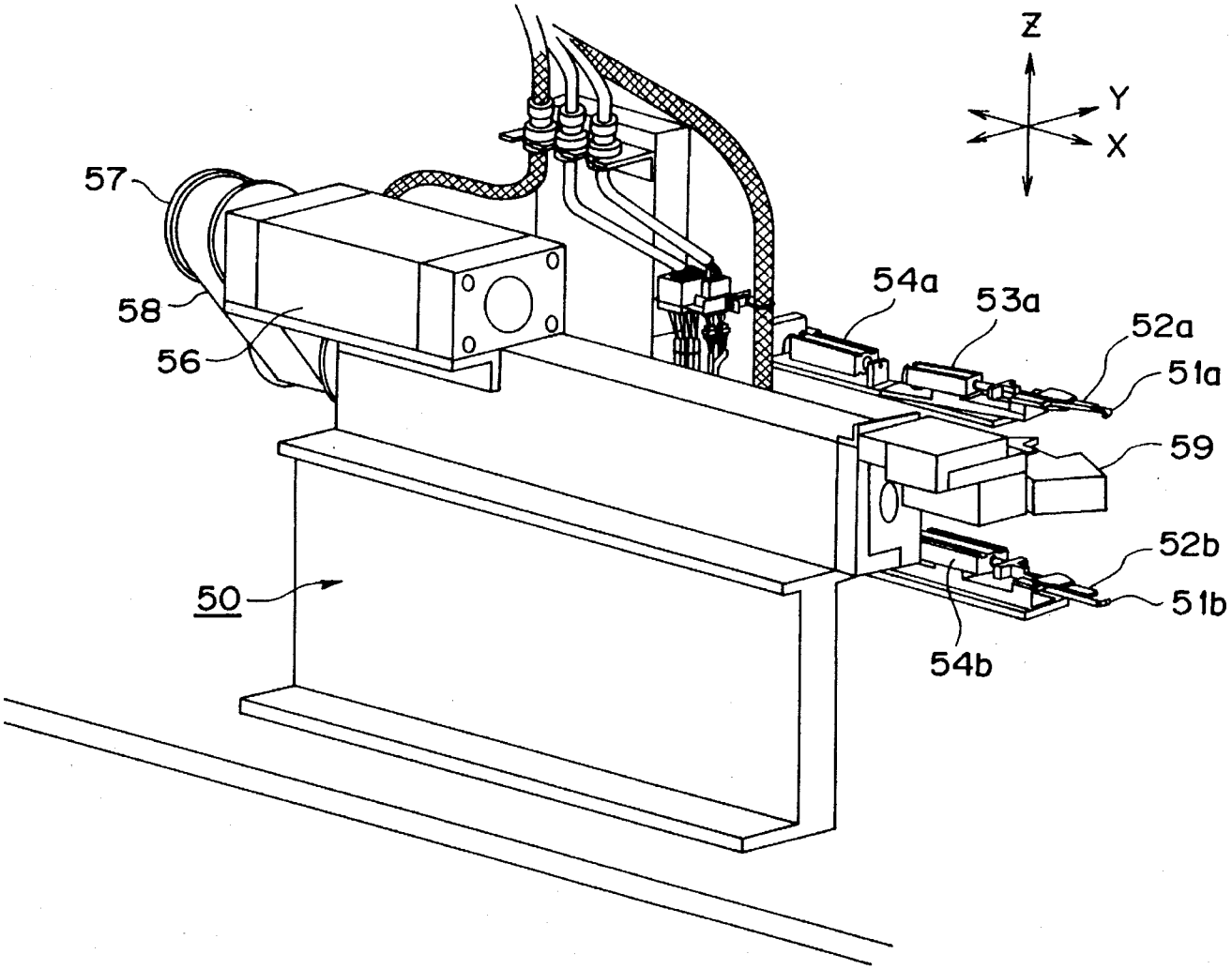
FIG. 7 is a perspective view showing a primary part of a guide unit of the winding apparatus shown in FIG. 3.
Figure 8:
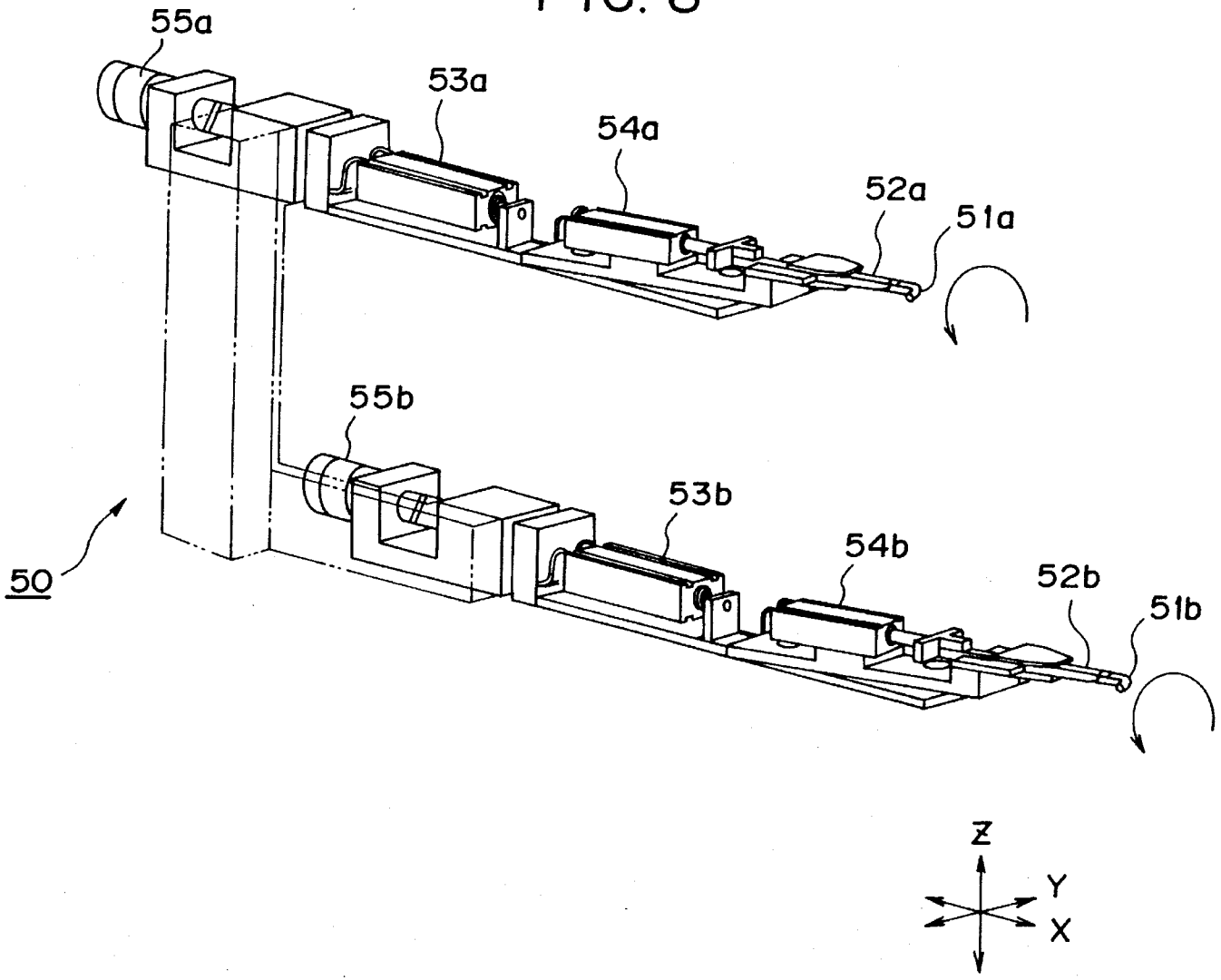
FIG. 8 is an illustration of an operation of the guide unit.
Figure 9:
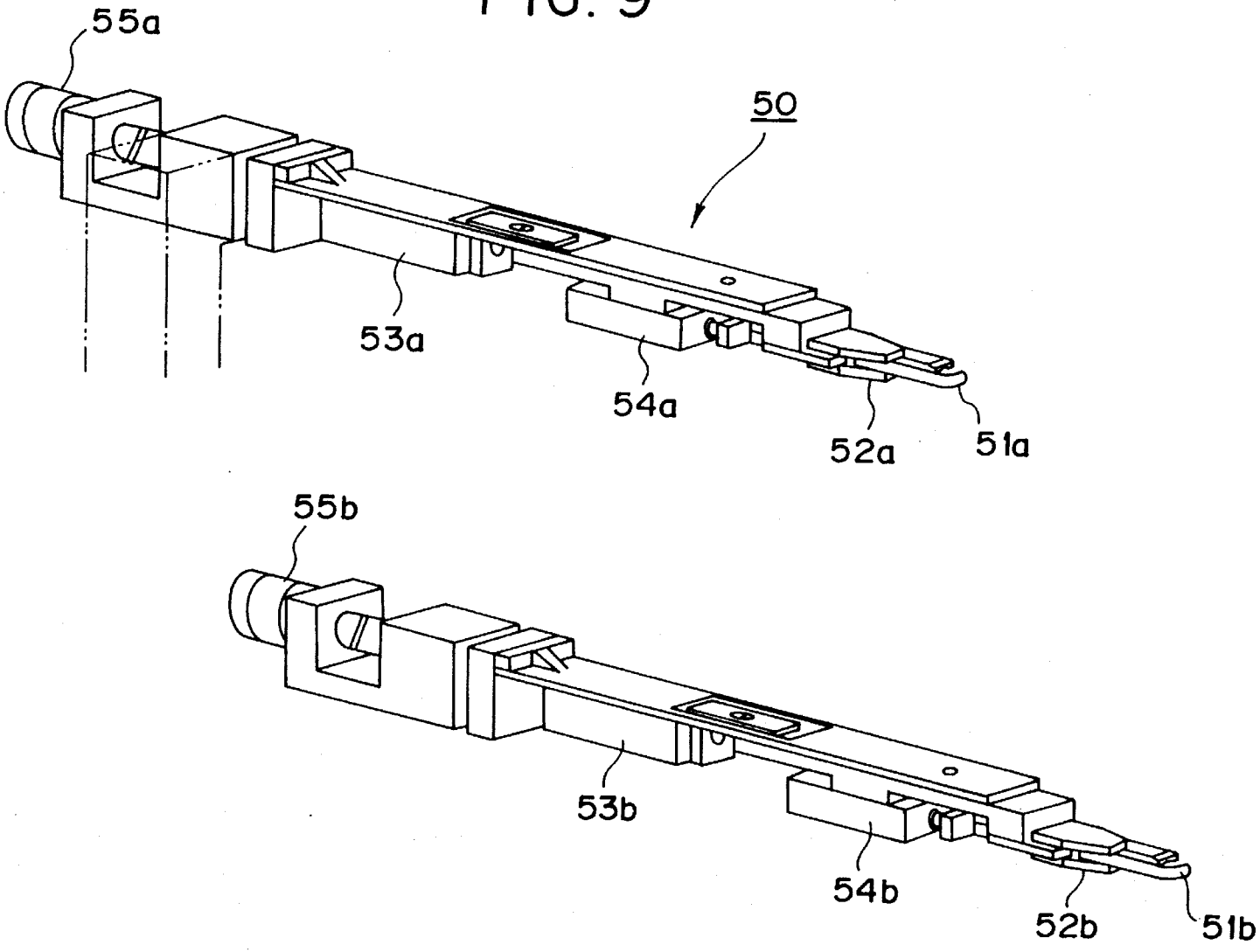
FIG. 9 is an illustration of another operation of the guide unit.

FIG. 7 is a perspective view showing a primary part of the guide unit 50. In FIG. 7, the guide unit 50 is composed of guide hooks 51*a* and 51*b*, retaining members 52*a* and 52*b*, cylinders 53*a*, 53*b*, 54*a* and 54*b*, rotary actuators 55*a* and 55*b*, a servo motor 56, a pulley 57, a belt 58 and the like. FIGS. 8 and 9 show an arrangement of the guide hooks 51*a* and 51*b*, the retaining members 52*a* and 52*b*, the cylinders 53*a*, 53*b*, 54*a* and 54*b*, and the rotary actuators 55*a* and 55*b*.

In the guide unit 50, the wire 9 that has been introduced through the nozzle 42 is held by the guide hook 51 and the retaining member 52, and the wire 9 is clamped by the clamping mechanism 70 provided on the work receiving base 60. Thereafter, the wire is engaged with the nozzle 42 and the work receiving base 60 upon the winding operation, thereby carrying out the winding operation to the work piece 21. After the winding operation, the wire is engaged by the retaining member 52, thereby retaining the wire at the work piece 21.

The operation of the guide unit 50 in the X axis direction (back-and-forth direction) is carried out by the drive of the servo motor 56 through the pulley 57 and the belt 58, whereas the operation thereof in the Z axis direction (viz., up-and-down or vertical direction) is carried out by a servo motor, a pulley and a belt (all not shown).

Side-to-side swinging of the guide hooks 51*a* and 51*b* is induced by the cylinders 53*a* and 53*b*, while the back-and-forth movement or feeding operations of the retaining members 52*a* and 52*b* are carried out by the cylinders 54*a* and 54*b*, respectively. During the retaining operation of the wire 9, the guide hooks 51*a* and 51*b*, the retaining members 52*a* and 52*b* and the cylinders 53*a*, 53*b*, 54*a* and 54*b* are all rotated by the drive of the rotary actuators 55*a* and 55*b*. FIGS. 8 and 9 show the state in which the guide hooks 51*a* and 51*b*, the retaining members 52*a* and 52*b* and the cylinders 53*a*, 53*b*, 54*a* and 54*b* are all rotated through 180° by the drive of the rotary actuators 55*a* and 55*b*. The rotation of the guide mechanism is performed of course in the retaining operation and also in changing the direction for hooking the wire with the guide hooks 51*a* and 51*b*.

Figure 10:
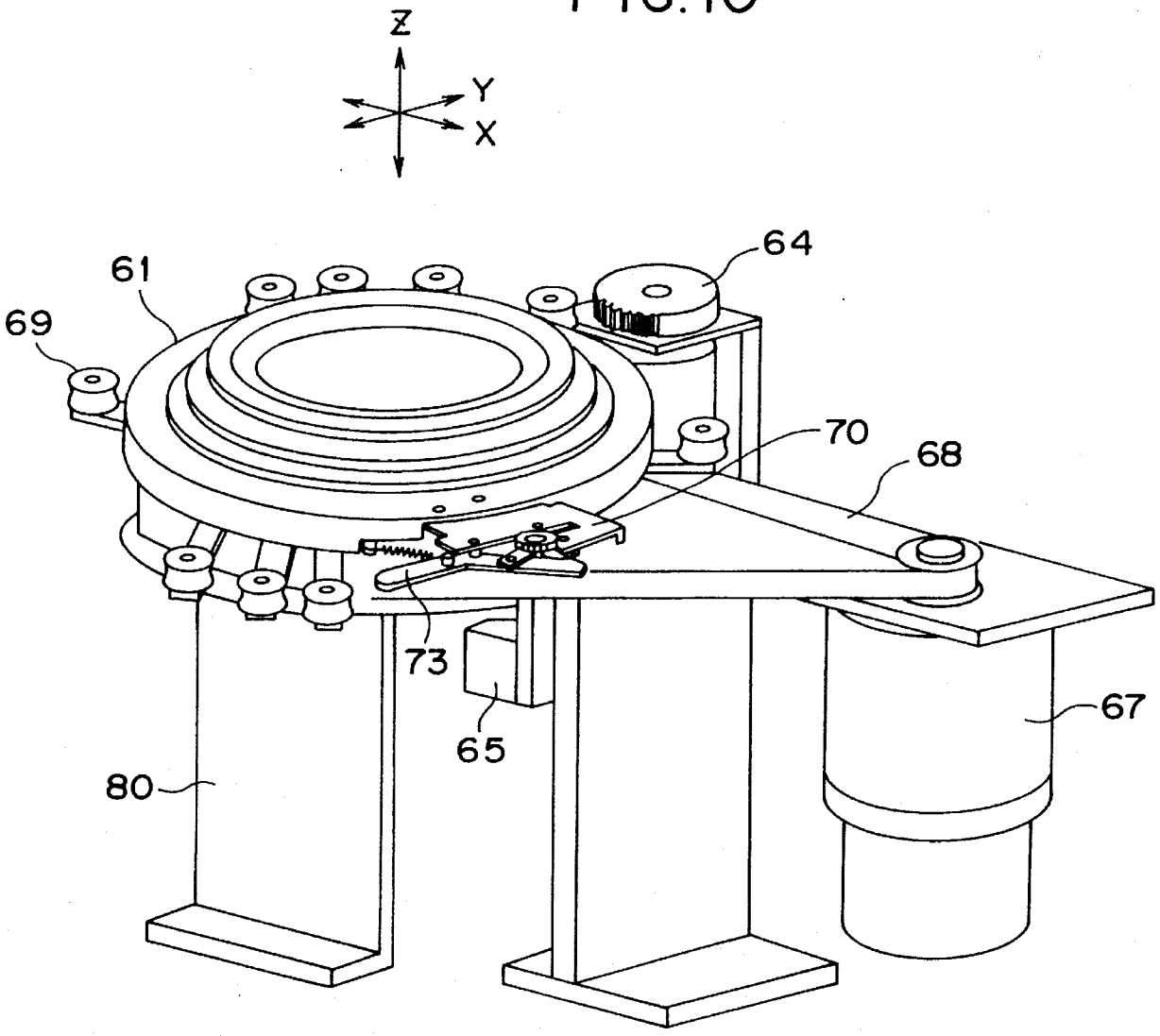
FIG. 10 is a perspective view showing an overall structure of a work receiving base of the winding apparatus shown in FIG. 3.
Figure 11:
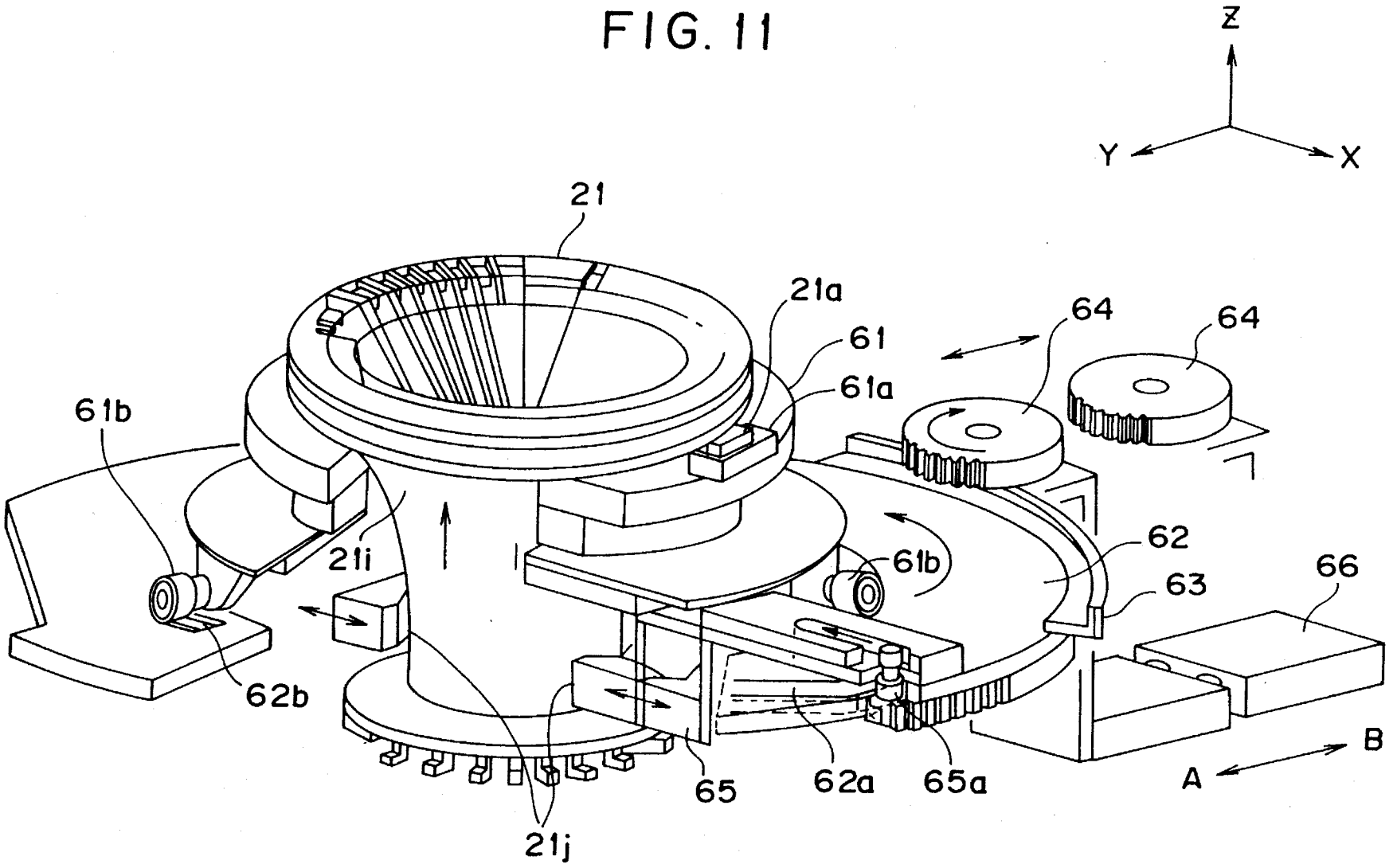
FIG. 11 is a detailed enlarged perspective view showing a work receiving base in accordance with the present invention.
Figure 12:
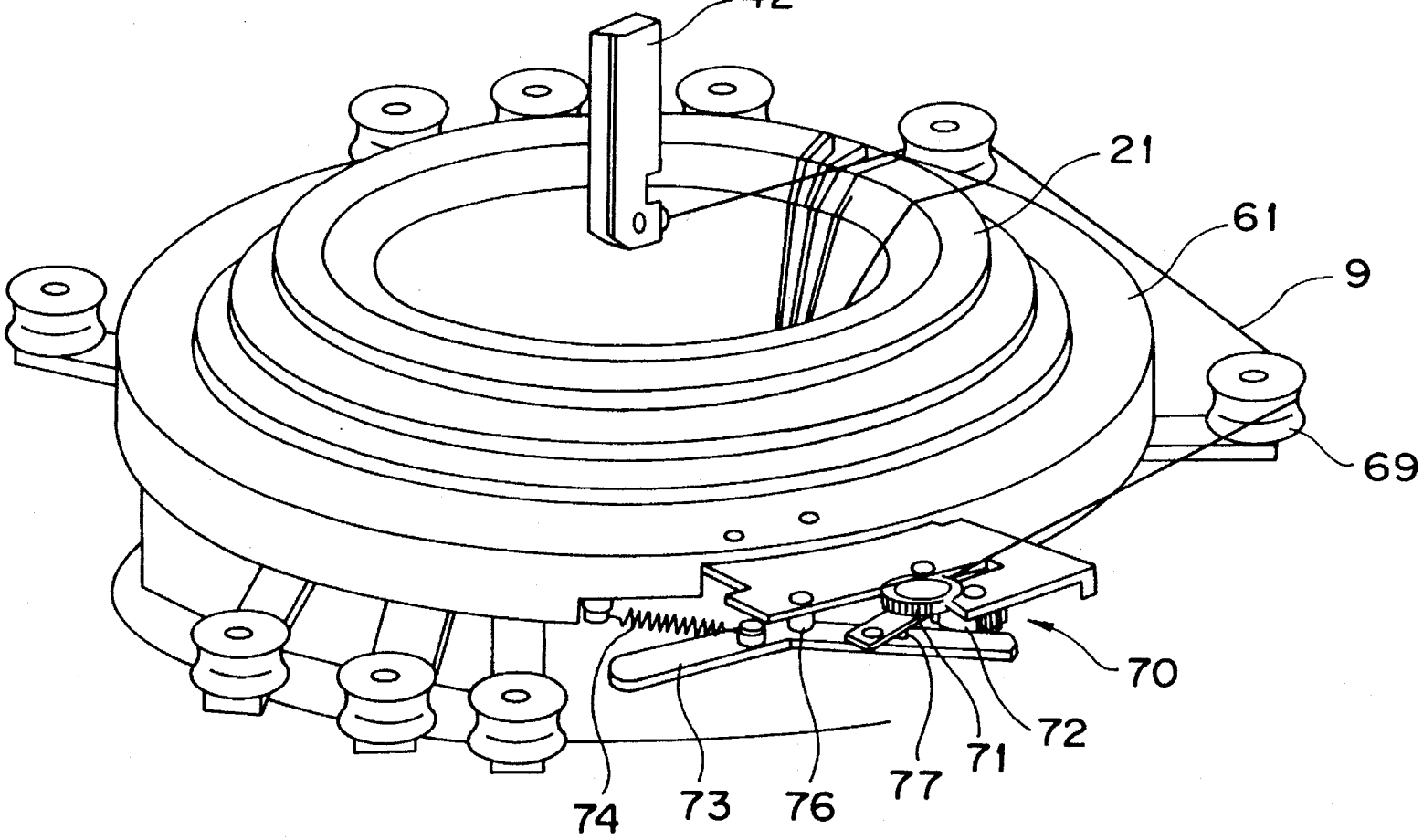
FIG. 12 is a perspective view showing a peripheral structure of the work receiving base of the winding apparatus of the invention.
Figure 13:
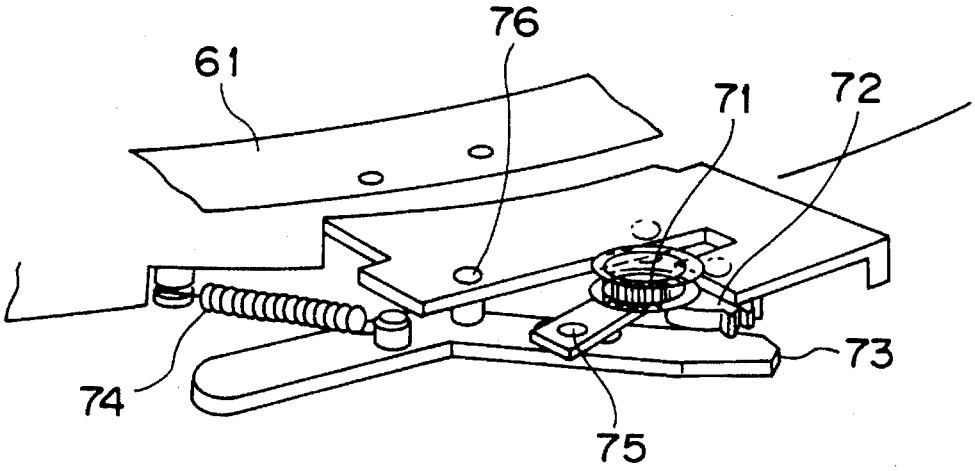
FIG. 13 is a perspective view showing a wire clamping mechanism in the winding apparatus of the invention.

FIG. 10 shows an overall structural perspective view showing the work receiving base 60. FIG. 11 is an enlarged perspective view of a primary part of the work receiving base 60. FIG. 12 is a perspective view showing a peripheral structure of the work receiving base 60.

Figure 1:
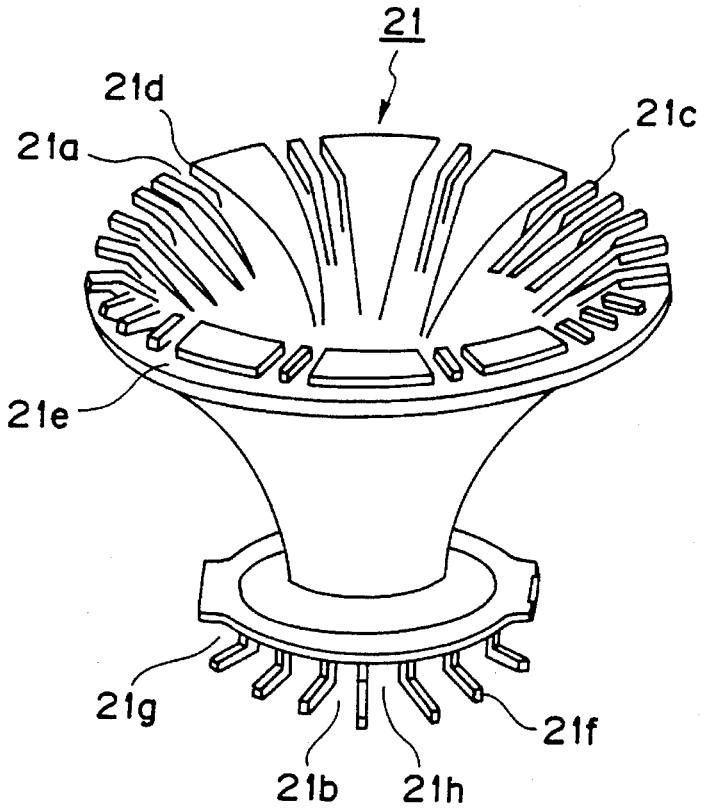
FIG. 1 is a perspective view showing a conventional deflection yoke frame.
Figure 2:
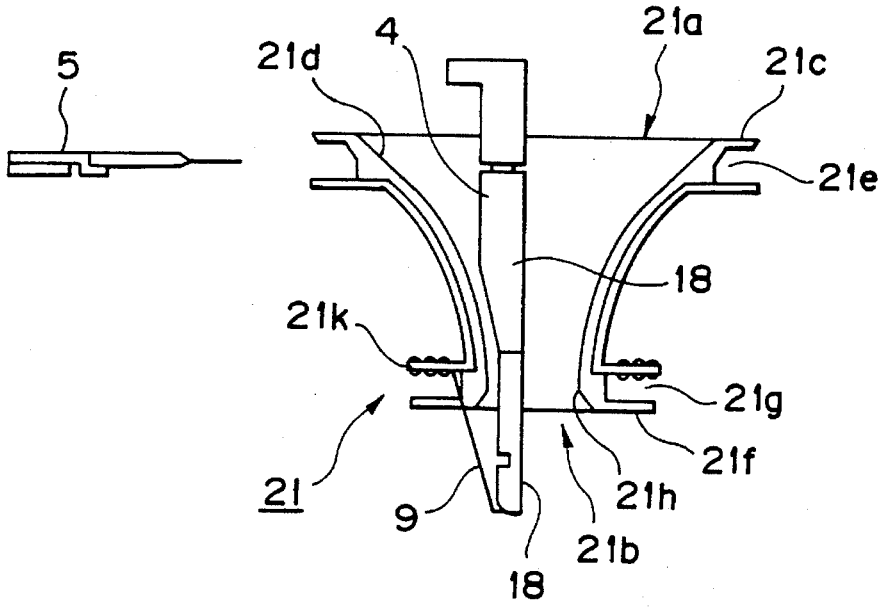
FIG. 2 is an illustration of a conventional winding method.
Figure 3:
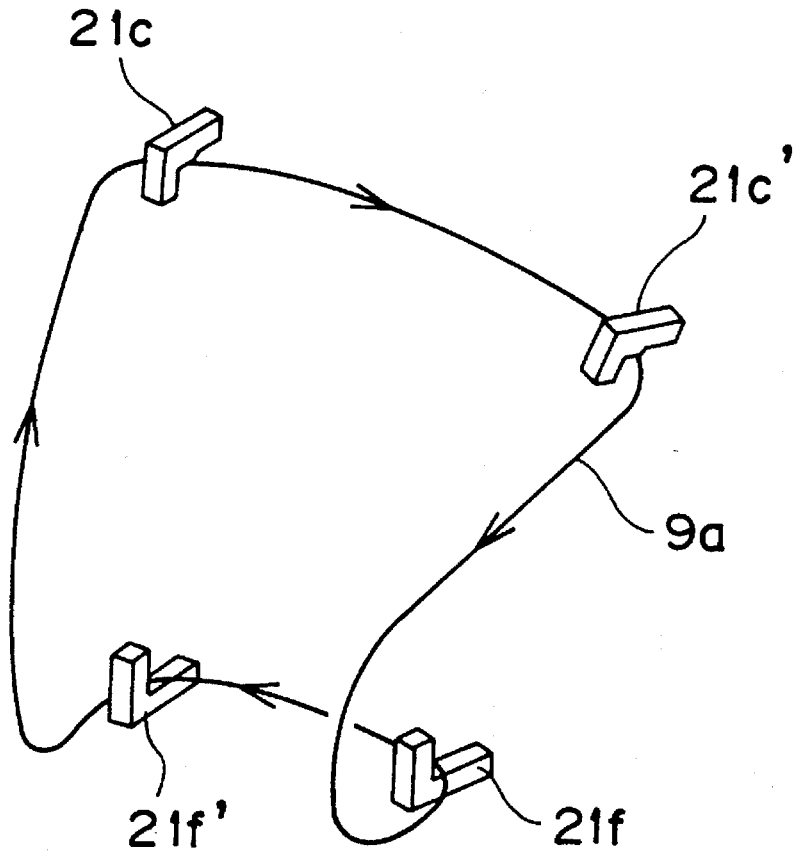
FIG. 3 is an illustration of the conventional winding operation.

In FIGS. 10, 11 and 12, the work receiving base 60 installed on a table (no-numeral), has a work receiving body 61 in which a funnel-like deflection yoke frame 21 (the same deflection yoke frame 21 as shown in FIG. 1) is disposed. A cam 62 is integrally formed with the outer circumference of the work receiving body 61. A sector 63 is engaged with the cam 62 and the pinion 64 in turn is meshed with the sector 60. When the pinion 64 is drivingly rotated, a pressure block 65 for gripping grip portions 21*j* of the deflection yoke frame 21, is advanced toward the deflection yoke frame 21 along a cam groove 62*a* of the cam 62 so that it is brought into contact with the deflection yoke frame 21 to thereby grip the grip portions 21*j*. On the other hand, in synchronism with the gripping operation of the grip portions 21*j*, the work receiving body 61 that supports the outer circumference on the side of the opening portion outer surface 21*a* of the deflection yoke frame 21, is also engaged with each groove 62*b* in the cam 62 so that a plurality of rotary members 61*b* are slightly raised to thereby secure the opening portion outer surface 21*i* of the deflection yoke frame 21. Namely, the vertical or up-and-down movement of the yoke 21 is limited by the grip portions 21*j* and the work receiving body 61.

FIGS. 13 to 16 show a detailed structure and operation of the wire clamping mechanism 70 formed on the work receiving base 70. The wire clamping mechanism 70 is operated after the pinion 64 is retracted to release the engagement between the sector gear 63 and the pinion 64. With reference to FIGS. 13 to 16, the pinion 64 is reciprocated along the Y axis (in the direction indicated by a double headed arrow A–B in FIG. 11). When the pinion 64 is retracted (in the direction indicated by the arrow B in FIG. 11), it is disengaged from the sector gear 63, whereas it moves forwardly (in the direction indicated by the arrow A in FIG. 11), the pinion 64 is engage with the sector gear 63.

Figure 14:
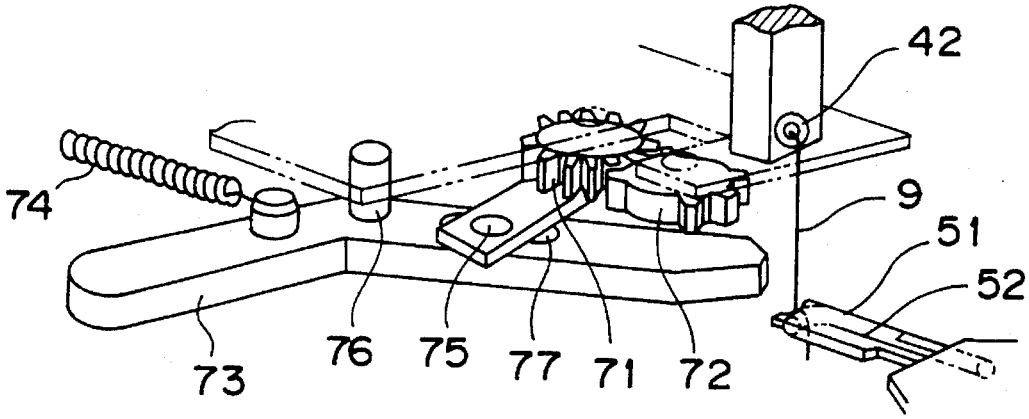
FIG. 14 is a view showing an operational state of the wire clamping mechanism of the winding apparatus of the invention.
Figure 15:
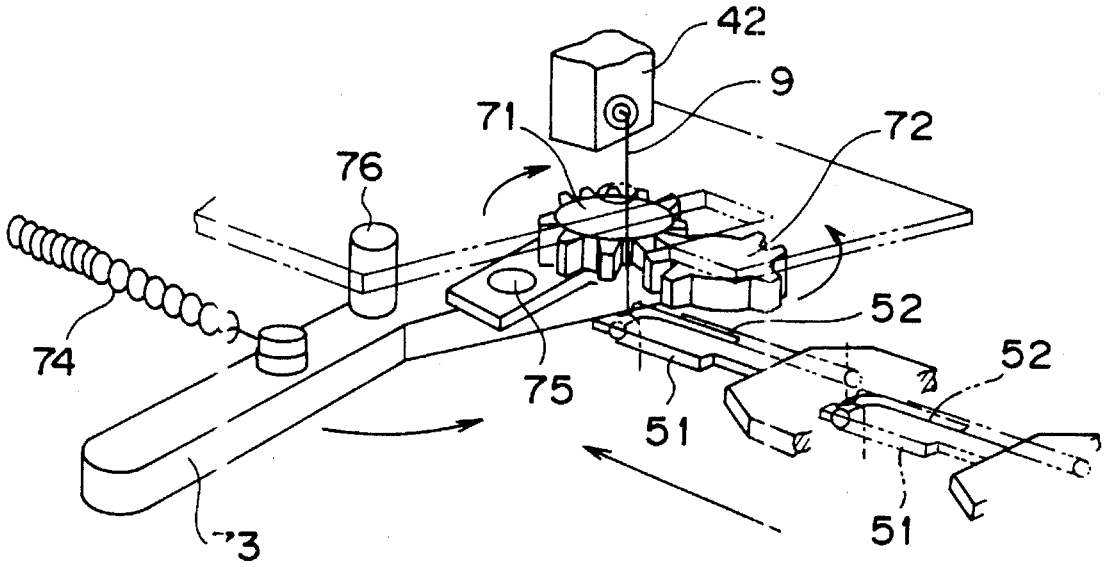
FIG. 15 is a view showing another operation state of the wire clamping mechanism of the winding apparatus of the invention.
Figure 16:
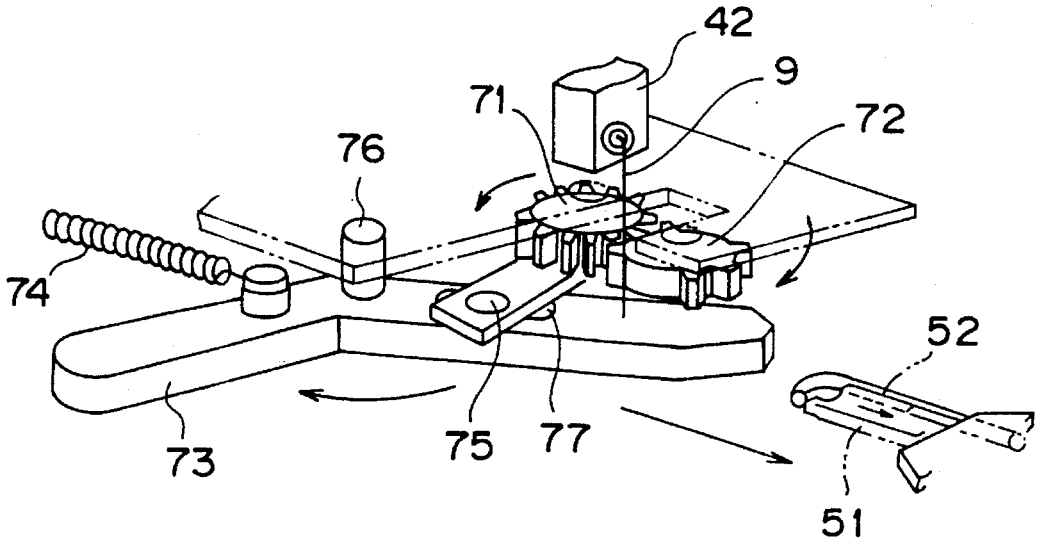
FIG. 16 is a view showing still another operation state of the wire clamping mechanism of the winding apparatus of the invention.

Subsequently, with respect to the clamping operation of the wire 9 in this case, under the condition that the wire 9 is laid between the nozzle 42 and the guide hook 51 is held as it is, the nozzle unit 40 and the guide unit 50 are forwarded toward the wire clamping mechanism 70 (see FIGS. 14 and 15). When the guide hook 51 pushes an arm 73 of the wire clamping mechanism 70, a pin 75 that connects a gear 71 and the arm 73 with each other is moved along an oblong hole 77 formed in the arm 73, and at the same time, the gear 71 is rotated clockwise. Thus, a gear 72 that engages with the gear 71 is rotated counterclockwise so that the wire 9 is inserted in a gap defined between teeth of the gear 71 and teeth of the gear 72 (see FIG. 16).

Next, the servo motor 67 is driven, and the work receiving body 61 on which the wire clamping mechanism 70 is rotated through a predetermined angle (θ°). When the guide unit 50 is moved rearwardly under the condition that the wire 9 may be released, the guide hook 51 that has pushed the arm 73, is moved rearwardly simultaneously therewith and the arm 73 returns back to its original position under the bias of a coil spring 74. Accordingly, the gear 71 and the gear 72 are rotated counter-clockwise and clockwise, respectively, and the wire 9 is clamped in the engagement between the gears 71 and 72. While the clamping operation of the wire 9 is carried out, the nozzle 42 is left at the stop position where it has inserted the wire 9.

Subsequently, under the condition that the wire 9 is clamped, the nozzle 42 is engaged with the work receiving body 61 and the adjustment of the orientation of the nozzle 42 is attained in synchronism with the rotation of the work receiving body 61 in order to facilitate the hook of the wire 9 to guide rollers 69 provided on the outer peripheral portion of the work receiving body 61. The wire 9 is moved to a wire winding position of the deflection yoke frame 21. Thus, the wire 9 is moved from the clamped position of the wire to the wire winding position through the guide rollers 69, so that a length of the free end portion of the wire 9 may be sufficient.

Also, when the wire is arranged in the wire winding position, the winding of the wire 9 is performed to the deflection yoke frame 21. In the winding of the wire 9 to the deflection yoke frame 21, first of all, the nozzle 42 is moved to the center of the large diameter portion 21*a* of the deflection yoke frame 21. Subsequently, the nozzle 42 is moved downwardly along the Z axis (up-and-down direction) and winds the wire 9 along curved winding grooves 21*d* of the deflection yoke frame 21. Subsequently, the wire 9 that has reached the small diameter portion 21*b* is retained by the guide hook 51*b*, and the wire is wound along the opening-portion circumferential winding groove 21*h* in cooperation with the rotation of the work receiving body 61. The guide hook 51*b* releases the wire 9 at a predetermined small diameter portion 21*b*. Then, the nozzle 42 is moved upwardly along the Z axis and the wire is retained by the guide hook 51*a*. the winding of the wire 9 is carried out in cooperation with the rotation of the work receiving base 61 up to a predetermined winding groove 21*d* along the opening portion circumferential groove 21*e* of the large diameter portion 21*a*. Thereafter, the wire is released, and again, the nozzle 42 is lowered along the Z axis to repeatedly perform the winding of the wire 9 around the deflection yoke frame 21.

After the completion of the winding of the wire 9 onto the deflection yoke frame 21, a cut clamp (not shown) is forwarded toward the wire 9 laid between the guide hook 51*a* and the nozzle 42 to thereby cut and clamp the wire 9.

As described above, according to the winding method and apparatus according to the present invention, even if the retaining pins are not provided on the work piece, because the wire clamping mechanism is provided on the work receiving base, the wire is clamped by the engagement operation between the nozzle unit and the wire clamping mechanism. Further, the coil winding operation of the wire onto the work piece is carried out by motions of the nozzle unit, the work receiving base and the wire guide mechanism. Accordingly, even if the retaining pins are not provided on the work piece, it is possible to wind the wire as desired. The winding precision is enhanced and the winding time may be shortened to enhance the productability etc.

Also, when the wire is clamped by the above-described clamping mechanism and the wire is wound at the retaining portion provided at a predetermined position of the work piece, if the guide rollers are provided for guiding the wire along the outer portion of the work piece, when the coil winding operation is effected, the wire is tensioned to the guide rollers provided on the outer peripheral portion of the work receiving base, and the tension may be applied to the wire right up to the work winding operational position. Accordingly, it is possible to set a sufficient length of the wire.

Various details of the invention may be changed without departing from its spirit nor its scope. Furthermore, the foregoing description of the embodiments according to the present invention is provided for the purpose of illustration only, and not for the purpose of limiting the invention which is defined only by the appended claims and their equivalents.

What we claim is:

1. A winding apparatus for winding a wire fed from a winding feeding source onto a work piece, comprising:

a work receiving base on which the work piece is supported;

a nozzle unit to which the wire is fed from the winding feeding source, said nozzle being operatively connected with servo means for moving said nozzle up and down with respect to said work receiving base;

a guide mechanism which is movable toward and away from said work receiving base for grasping the wire from said nozzle unit and for drawing the wire to the work piece supported on said work receiving base;

a wire clamp for clamping the wire that has been guided by said guide mechanism to the work piece; and rotary means for rotating the work receiving base, wherein after the wire has been clamped by said wire clamp, the wire is wound on the work piece by vertical movement of said nozzle unit, a holding operation of said guide mechanism and a rotational operation of said rotary means.

2. The apparatus according to claim 1, wherein said nozzle includes a nozzle tip end portion which comprises a nozzle body, a head socket and nozzle head.

3. The apparatus according to claim 2, further comprising nozzle rotating means for rotating said nozzle tip end portion relative to said nozzle unit and said work receiving base.

4. The apparatus according to claim 1, wherein said guide mechanism comprises a guide hook for hooking the wire and guiding the wire in a predetermined direction, and a retaining member for holding the wire that has been hooked by said guide hook, said guide hook and said retaining member being provided at an end of said guide mechanism.

5. The apparatus according to claim 4, further comprising actuating means for actuating said guide mechanism, wherein said actuating means comprises a first cylinder for swinging said guide hook and said retaining member about a first axis, and a second cylinder for moving said hook member and said retaining member back and forth along a second axis which is perpendicular to the first axis.

6. The apparatus according to claim 5, wherein said actuating means further comprises a rotary actuator for rotating said guide mechanism as a whole about the second axis.

7. The apparatus according to claim 1, further comprising a work holding mechanism for fixing the work piece to said work receiving base.

8. The apparatus according to claim 7, wherein said holding means includes a cam provided on said work receiving base, a sector gear engageable with said cam, a drivingly rotated pinion, and a pressure block, said pressure block being responsive to the movement of said cam, said sector gear and said pinion for gripping the work piece and holding the work piece on said work receiving base.

9. The apparatus according to claim 8, further comprising an actuator operatively connected with said pinion for selectively moving said pinion into engagement with said sector gear and for selectively retracting said pinion away from said sector gear for releasing the engagement between said pinion and said sector.

10. The apparatus according to claim 1, further comprising a plurality of guide rollers for guiding the wire from said wire clamp to a wire winding position on the work piece.

11. The apparatus according to claim 10, wherein said plurality of wire guide rollers are disposed around an outer mechanism and disposed in positions to be engageable with the wire that has been hooked by said guide hook.

12. The apparatus according to claim 11, wherein said wire clamp is composed of a plurality of gears which engage with each other and which are arranged so that the wire may be inserted between said plurality of gears in a manner to be clamped therebetween.

13. A winding method for winding a wire fed from a winding feeding source to a work piece in a winding apparatus, said apparatus comprising:

a work receiving base on which the work piece is supported;

a nozzle unit to which the wire is fed from the winding feeding source, said nozzle being operatively connected with servo means for moving said nozzle up and down with respect to said work receiving base; and a guide mechanism which is movable toward and away from said work receiving base for grasping the wire from said nozzle unit and for guiding the wire to the work piece supported on said work receiving base;

a wire clamp for clamping the wire that has been guided by said guide mechanism to the work piece; and rotatory means for rotating the work receiving base, said winding method comprising the the steps of:

clamping the wire by said wire clamp; and after said clamping, winding the wire onto the work piece using a movement of said nozzle unit, a holding operation of guide mechanism and a rotational operation of said rotary means.

14. The method according to claim 13, further comprising the steps of:

hooking the wire and guiding the wire in a predetermined direction using a guide hook which forms part of said guide mechanism; and holding the wire which has been hooked by the guide hook, against a retaining member provided on said guide mechanism.

15. The method according to claim 14, further comprising the steps of:

swinging the guide hook and retaining member of said guide mechanism about a first axis;

moving said guide hook and retaining member back and forth along a second axis which is perpendicular to the first axis; and rotating said guide mechanism as a whole about the second axis.

16. The method according to claim 13, further comprising the step of: fixing the work piece to said work receiving base.

17. The method according to claim 16, wherein said work holding means includes a cam provided on said work receiving base, a sector gear engageable with said cam, a drivingly rotated pinion, and a pressure block for gripping the work in response to operative engagement of said cam, said sector gear and said pinion, said method further comprising the steps of:

engaging said pinion and said sector gear with each other; and retracting said pinion from said sector gear for releasing the engagement between said pinion and said sector.

18. The method according to claim 13, further comprising the step of using a plurality of guide rollers for guiding the wire from said wire clamp to a wire winding position of the work piece.

19. The method according to claim 18, wherein said plurality of wire guide rollers are disposed about an outer circumferential peripheral portion of said work receiving base.

20. The method according to claim 19, wherein said wire clamp is composed of a plurality of gears that engage with each other so that the wire may be inserted and clamped therebetween.

* * * * *